US006422562B1

(12) United States Patent
Daniel

(10) Patent No.: US 6,422,562 B1
(45) Date of Patent: Jul. 23, 2002

(54) WORD GAME

(76) Inventor: David D. Daniel, 29711 Airline Hwy., Paicines, CA (US) 95043

( * ) Notice: Subject to any disclaimer, the term of this patent is extended or adjusted under 35 U.S.C. 154(b) by 0 days.

(21) Appl. No.: 09/947,815

(22) Filed: Sep. 6, 2001

(51) Int. Cl.[7] ..... A63F 3/00
(52) U.S. Cl. ..... 273/272; 273/429
(58) Field of Search ..... 273/272, 299, 273/429, 430

(56) References Cited

U.S. PATENT DOCUMENTS 3,734,506 A * 5/1973 Gingrass
4,934,711 A * 6/1990 Runstein
4,955,614 A * 9/1990 Buda

* cited by examiner

*Primary Examiner*—William M. Pierce
(74) *Attorney, Agent, or Firm*—Jeffrey A Hall

(57) ABSTRACT

A word game comprising the steps of turning a plurality of letter tiles upside down with each letter tile having a single letter on one side thereof. Next, distributing a word bracket, a score pad, and a writing implement to all players. Then a die is thrown to determine which player goes first, and each player then draws a single letter tile until each player can form a three letter word composed of a plurality of letters. The players then take turns guessing the word that another player has by making a guess of a three letter word with each guess responded to by the answer 'odd' or 'even' corresponding to either an odd or even number of correct letters guessed respectively. Points are scored for the player who correctly guessed the word.

19 Claims, 2 Drawing Sheets

WORD GAME

BACKGROUND OF THE INVENTION

1. Field of Invention

This invention relates to games, and more particularly to a game where the object of the game is to guess your opponent's word and score the most points.

2. Description of the Related Art

Heretofore a wide variety of word games have been proposed and implemented for entertainment, diversion, fun and educational purposes. The present invention is a novel and unique word game where the object of the game is to guess your opponent's word and score the most points. The game is entertaining, fun, and educational, and may be played by children, adolescents, and/or adults.

The present invention provides a novel game methodology where, after preliminary preparation and set-up, each player draws letters from a plurality of letter tiles to form a three letter word. As soon as the player can form a three letter word he stops drawing and forms the word on a letter bracket. The other players continue to draw letter tiles until they can each form a three letter word. Once the word is formed it cannot be changed during the round of play.

The player who formed a three letter word first begins the play. Each player takes turns in trying to guess his opponent's word. this is done by making a guess of a three letter word to your opponent. For three or four players, this would be the player on their left side. Each guess is responded to by the opponents with the answer 'odd' or 'even'. 'Odd' signifies that one or three letters match. 'Even' signifies that zero or two letters match. Once a word has been guessed, this ends the round of play. The player that guessed the word scores his points on the score pad. Play then continues as before with the exception that everyone draws letter tiles until a four letter word can be formed.

Play may continue up to seven or more letters.

Accordingly, it is the primary object of this invention to provide a novel and unique word guessing game which is entertaining, fun, and educational. It is a further object of this invention to provide a game which may be played and enjoyed by both children, adolescents, and adults.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims

BRIEF SUMMARY OF THE INVENTION

The present invention is a word game comprising the steps of turning a plurality of letter tiles upside down or otherwise covering the tiles. Each letter tile has a single letter on one side thereof. Next, distributing a word bracket, a score pad, and a writing implement to all players. Then a die is thrown to determine which player goes first, and each player then draws a single letter tile until each player can form a three letter word. The players then take turns guessing the word that another player has by making a guess of a three letter word with each guess responded to by the answer 'odd' or 'even' corresponding to either an odd or even number of correct letters guessed respectively. Points are scored for the player who correctly guessed the word. The play may continue with increasing lengths of words up to seven letters in length.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DETAILED DESCRIPTION OF THE INVENTION

Reference will now be made in detail to the present preferred embodiments of the invention as illustrated in the accompanying drawings.

Figure 4:
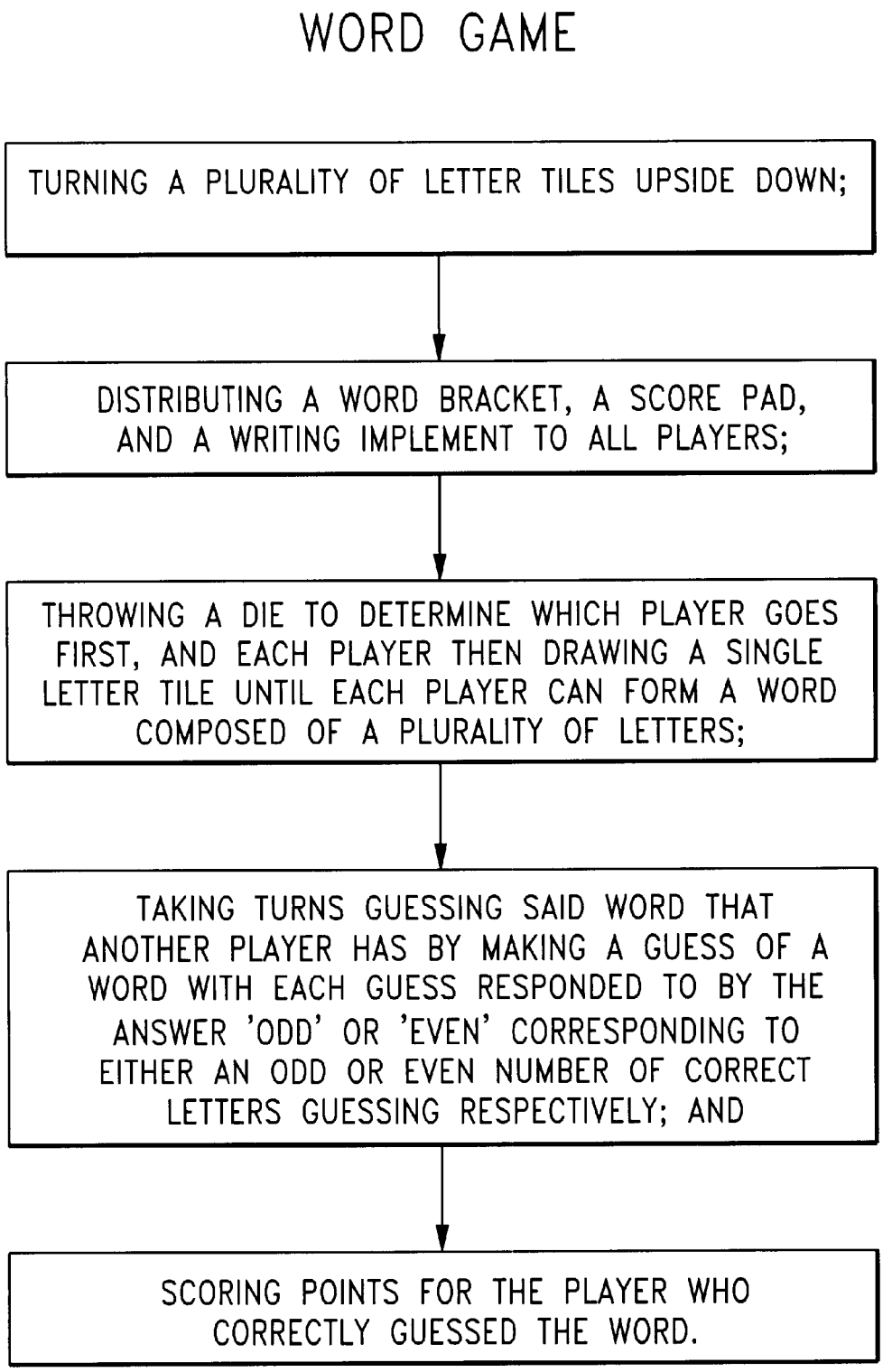
FIG. 4 shows a flow chart showing the steps of the word game, according to the invention.

In accordance with the present invention, there is provided a word game for entertainment, fun and educational purposes, comprising the steps, best seen in FIG. 4., of turning a plurality of letter tiles upside down with each letter tile having a single letter on one side thereof. Next, a word bracket, a score pad, and a writing implement are distributed to all players. Then a die is thrown to determine which player goes first, and each player then draws a single letter tile until each player can form a three letter word. The players then take turns guessing the word that another player has by making a guess of a three letter word with each guess responded to by the answer 'odd' or 'even' corresponding to either an odd or even number of correct letters guessed respectively. Points are scored for the player who correctly guessed the word. The play may continue with longer words for each subsequent round up to seven, or play may be stopped at any time.

Figure 1:
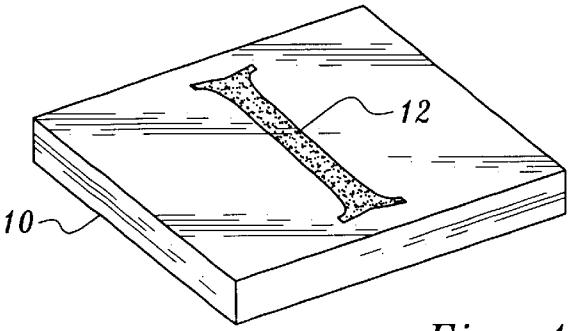
FIG. 1 is a letter tile, according to the invention.
Figure 2:
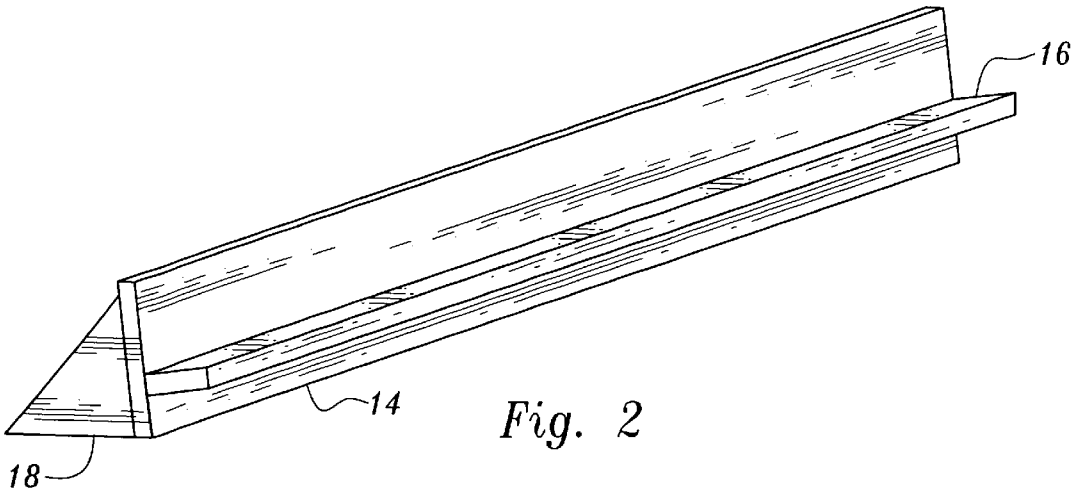
FIG. 2 shows a letter tile bracket, according to the invention.

The object of the game of this invention is to guess your opponent's word and score the most points. The preferred equipment for playing the game comprise a plurality of letter tiles 10, as seen in FIG. 1. Preferably 100 tiles are used, each tile 10, has a letter of the alphabet printed, stamped, carved or otherwise impressed on a surface of each tile. The wooden tiles are lettered in proportion to their use in the English language. Of course, if the game is to be provided in other languages, such as Spanish, German, or Japanese, for example, the number of a particular lettered tile would correspond to use of that particular letter in the subject language. Preferably, each tile 10, is one inch by one inch by one-eighth of an inch, and are composed of wood, however, variations in the size, dimensions, and composition are contemplated. For example, tiles 10 may be alternatively composed of plastic, metal, or the like. In FIG. 2, a letter tile bracket 14 is shown, according to a preferred embodiment of the invention. Preferably, tile bracket 14 has a shelf 16, for holding letter tiles 10, and a support brace or bracket 18. Preferably letter tile bracket 14, is composed of a plastic about one-eighth of an inch thick and is about seven and seven-eighths inches long. Of course, various size tile brackets may be provided either larger or smaller than the given example. Similarly, tile bracket 14, may be composed of other materials such as wood or metal.

Figure 3:
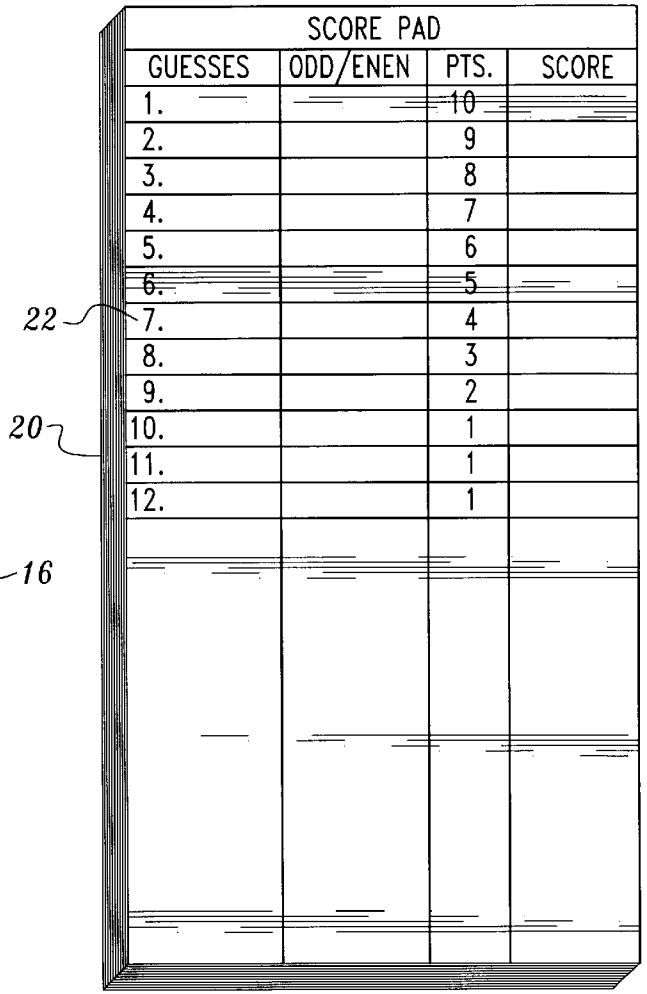
FIG. 3 shows a score pad, according to the invention.

With reference now to FIG. 3, a score pad 20, is shown for keeping score and the record of guesses and responses. Preferably, score pad 20 has four columns. The first column is for each of a player's guesses. The second column is to record an opponent's response to a guess. The third column includes a numerical score for each guess in the first column. The forth column preferably is for recording the score from each round of play. Of course, the exact size, dimensions and use of the columns may vary as desired. Pencils, pens, or other writing implements may be used to mark score pad 20.

In the preferred method, letter tiles 10 are turned up side down so that the letter is not visible and mixed thoroughly. Each player takes a word bracket 14, a score pad 20, and a pencil or other writing implement. Each player starts by throwing a die to determine who goes first. Each player then takes turns in drawing letter tiles until a three letter word can be formed. As soon as a player can form a three letter word he/she stops drawing and forms the word on letter bracket 14, out of view from the other players. The other players continue to draw until they can each form a three letter word. Once play has begun, the word cannot be changed during that round of play.

Once each player as a three letter word, play begins. The player who formed a three letter word first begins the play. Preferably, each player takes turns in trying to guess his opponent's word. this is done by making a guess of a three letter word to you opponent. For three or four players, this would preferably be the person to the player's left, but may be otherwise. Each guess is responded to by the opponent with the answer 'odd' or 'even'. 'Odd means that one or three letters match. 'Even' means that zero or two letters match.

Preferably, the game is played so that letters must match exactly and be in the same position. Players keep track of their guesses by marking score pad 20. With each turn players use their previous results to make better guesses until someone guesses his opponent's word. However, in a preferred method of play, an opponent does not have to admit that the word has been guessed until the player asks "Is that the word?". At that time this opponent must answer yes if the correct word has been guessed. Once a word has been guessed, this ends the round. The player that guessed the word scores his points on the score pad. The other player's score would be zero for this round.

Play continues in the next round as before with the exception that all players draw letter tiles until a four letter word can be formed. this time whoever guessed the previous word makes the first guess in this new round of play. Players continue rounds of play, and may increase the number of letters in their words by one in each round. Play can continue up to seven letters or more, or the play may be ended at any time. The player who has the most points at the end of play is the winner.

An example of play is that an opponent has the word 'car'. The other player guesses 'bat'. The opponent would then answer with the response of 'odd'. Since one letter is the same and in exactly the same place, and one is an odd number, then the correct reply is 'odd'. Using the same word as before, 'car', suppose the guess of 'bar' is made. Now two letters are the same and in exactly the same position in the word. Here, the correct response would be, 'even', since two is an even number.

In the preferred method of play, scoring 22 is recorded on score 20, as seen in FIG. 3. As illustrated, point value is decreased with an increased number of guesses. Of course other scoring schemes and values may be used, FIG. 3, illustrating one method. Preferably, the point value never reaches zero, and that the sooner an opponents word is guessed, the higher the point value for that round of play.

Alternatively, the game may be played with three letter words every round if desired, or four letters, or five or more. Or, it is possible to play the game with as few as two letter words being used. The word game of the present invention is also easily adapted for play on a personal computer or game console.

As is evident from the above description, herein and additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept

What is claimed is:

1. A game methodology, comprising the steps of:

turning a plurality of letter tiles upside down;

distributing a word bracket, a score pad, and a writing implement to all players;

throwing a die to determine which player goes first, and each player then drawing a single letter tile until each player can form a word composed of a plurality of letters;

taking turns guessing said word that another player has by making a guess of a word with each guess responded to by the answer 'odd' or 'even' corresponding to either an odd or even number of correct letters guessed respectively; and scoring points for the player who correctly guessed the word.

2. The game of claim 1, wherein said guessing is first initiated by said player who first formed a word followed in turn by the player positioned to the players left.

3. The game of claim 1 wherein said word formed from a plurality of letters is a three letter word.

4. The game of claim 1 wherein said word formed from a plurality of letters is a four letter word.

5. The game of claim 1 wherein said word formed from a plurality of letters is a five letter word.

6. The game of claim 1 wherein said word formed from a plurality of letters is a six letter word.

7. The game of claim 1 wherein said word formed from a plurality of letters is a seven letter word.

8. The game of claim 1, wherein said players keep records and scores by marking a score pad.

9. The game of claim 1, wherein said players keep said plurality of letters or said word on a word bracket.

10. The game of claim 1, wherein said players keep said letter tiles are composed of wood.

11. The game of claim 1, further including the step of continuing play after a player has correctly guessed said word with a next round of play wherein a word is formed that is one letter longer than said word in the prior round of play.

12. A game playing method, comprising the steps of:

turning a plurality of letter tiles upside down, each letter tile having a single letter on one side thereof;

distributing a word bracket, a score pad, and a writing implement to all players;

throwing a die to determine which player goes first, and each player then drawing a single letter tile until each player can form a three letter word composed of a plurality of letters;

taking turns guessing said word that another player has by making a guess of a three letter word with each guess responded to by the answer 'odd' or 'even' corresponding to either an odd or even number of correct letters guessed respectively; and scoring points for the player who correctly guessed the word.

13. The game of claim 12, wherein said guessing is first initiated by said player who first formed a word followed in turn by the player positioned to the players left.

14. The game of claim 12 wherein said word formed from a plurality of letters is a four letter word.

15. The game of claim 12, wherein said word formed from a plurality of letters is a five letter word.

16. The game of claim 12, wherein said word formed from a plurality of letters is a six letter word.

17. The game of claim 12 wherein said word formed from a plurality of letters is a seven letter word.

18. The game of claim 12, further including the step of continuing play after a player has correctly guessed said word with a next round of play wherein a word is formed that is one letter longer than said word in the prior round of play.

19. The game of claim 12, wherein said game is played on a personal computer or game console.

* * * * *